US005490786A

United States Patent [19]

Mosquera et al.

[11] Patent Number: 5,490,786

[45] Date of Patent: Feb. 13, 1996

[54] TERMINATION OF CONTACT TAILS TO PC BOARD

[75] Inventors: Rene A. Mosquera, Laguna Niguel; Wayne A. Zahlit, Mission Viejo, both of Calif.

[73] Assignee: ITT Corporation, New York, N.Y.

[21] Appl. No.: 217,792

[22] Filed: Mar. 25, 1994

[51] Int. Cl.[6] ..... H01R 9/09

[52] U.S. Cl. ..... 439/79; 439/83

[58] Field of Search ..... 439/60, 79, 80, 439/83, 629–637; 29/827, 840, 843, 860

[56] References Cited

U.S. PATENT DOCUMENTS

| | | | |
|---|---|---|---|
| 2,116,562 | 5/1938 | Cruser | 219/26 |
| 2,336,904 | 12/1943 | Ward | 219/26 |
| 3,382,564 | 5/1968 | Gallentine | 29/471.1 |
| 3,474,521 | 10/1969 | Schwenn | 29/471.3 |
| 3,517,438 | 6/1970 | Johnson et al. | 29/627 |
| 3,589,591 | 6/1971 | Schwenn | 228/44 |
| 3,921,884 | 11/1975 | McDonough et al. | 228/44.1 |
| 3,943,323 | 3/1976 | Smith et al. | 219/85 |
| 3,948,429 | 4/1976 | Davies et al. | 228/44.1 |
| 4,484,704 | 11/1984 | Grassauer et al. | 228/180 |
| 4,505,035 | 3/1985 | Burton et al. | 29/843 |
| 4,583,807 | 4/1986 | Kaufman et al. . | |
| 4,621,880 | 11/1986 | Rush . | |
| 4,653,682 | 3/1987 | Dines et al. | 228/180.2 |
| 4,693,408 | 9/1987 | Dines et al. | 228/47 |
| 4,793,816 | 12/1988 | Pittman et al. | 439/79 |
| 4,889,275 | 12/1989 | Mullen, III et al. | 228/180.2 |
| 4,889,277 | 12/1989 | Zahn | 228/180.2 |
| 4,891,496 | 1/1990 | Zimmer | 219/233 |
| 4,910,383 | 3/1990 | Zimmer | 219/233 |
| 4,918,277 | 4/1990 | Zimmer | 219/56.1 |
| 4,932,885 | 6/1990 | Scholz | 439/79 |
| 4,989,318 | 2/1991 | Utunomiya et al. | 29/843 |
| 4,992,052 | 2/1991 | Verhoeven | 439/79 |
| 5,081,764 | 1/1992 | Utunomiya et al. | 29/843 |
| 5,201,662 | 4/1993 | Roche | 439/79 |
| 5,238,413 | 8/1993 | McCaffrey et al. | 439/79 |
| 5,245,509 | 9/1993 | Seitz | 361/720 |
| 5,277,596 | 1/1994 | Dixon | 439/79 |
| 5,281,152 | 1/1994 | Takahashi et al. | 439/79 |
| 5,281,165 | 1/1994 | McCleerey et al. | 439/510 |

*Primary Examiner*—Gary F. Paumen
*Assistant Examiner*—Hien D. Vu
*Attorney, Agent, or Firm*—Freilich Hornbaker Rosen

[57] ABSTRACT

A connector has upper and lower rows of contacts (20, 22, FIG. 4 ) whose contact tails (40, 42) are soldered to front and rear rows of pads (26, 24) on a circuit board (14), which provides flexibility in downward deflection of all contact tails in a short forward-rearward distance (B) . While the upper tails of the upper row of contacts extend at a downward-forward incline, the lower tails have rear portions (80) with inclined parts (90) that extend at an upward-forward incline, and forward portions (82) with inclined parts (92) that extend at downward-forward inclines. A heating bar (102, FIG. 7 ) for heating the forward ends (120, 122) of the contact tails for reflow soldering to the pads, has slots (124) in its lower surface (106) that extend from its rear end (126) to a location (130) behind its front end (132).

7 Claims, 2 Drawing Sheets

TERMINATION OF CONTACT TAILS TO PC BOARD

BACKGROUND OF THE INVENTION

In one type of termination arrangement in which the tails of connector contacts are terminated to conductive pads on a circuit board, the contacts are arranged in upper and lower rows and the circuit board pads are arranged in forward and rearward rows. While the upper contact tails have rear ends lying above the top of the circuit board and merely extend at a downward incline to the pads, the lower contacts may lie at or below the top face of the circuit board and may not be as flexible in downward bending as are the upper tails, While flexibility in downward bending of the tails can be increased by extending the length of the tails, there are applications where there is minimal space for the tails and conductive pads, such as in miniature IC (integrated circuit) cards. A termination arrangement which increased tail flexibility while minimizing the forward-to-rearward dimension occupied by the tails and pads, would be of value.

The forward ends of the tails are usually terminated to the pads by reflow soldering, wherein a hot bar may be pressed down against the front ends of the tails. The hot bar heats the front ends of the tails and layers of solder that are sandwiched between the tail ends and the conductive pads. It would be desirable if the hot bar and the termination arrangement were designed to facilitate the reflow soldering of two rows of contact tails to corresponding rows of pads on the circuit board.

SUMMARY OF THE INVENTION

In accordance with one embodiment of the present invention, a termination or contact arrangement is provided wherein vertically spaced rows of contact tails are terminated to horizontally spaced rows of circuit board conductive pads, wherein the tails are constructed for flexibility along a short length, and a heating bar is provided to heat the forward ends of the contact tails for reflow soldering. The upper tails of an upper row of contacts extend at a downward incline between their rear and forward ends. The lower tails have rearward portions with parts that extend at an upward-forward incline to a height above the circuit board, and have forward portions with parts that extend at a downward-forward incline to the front ends that lie against the circuit board pads. The front ends of the lower tails terminate to the forward row of pads, while the front ends of the upper tails terminate to the rearward row of pads. The bent configuration of the lower tails provides the necessary degree of flexibility in downward bending over a relatively short forward distance, to enable the use of relatively short lower tails.

A heating bar for heating the front ends of the tails for reflow soldering, has slots in the rearward portion of its lower surface. The slots receive portions of the lower contacts that lie behind their front ends without pressing against the received lower contact portions.

The novel features of the invention are set forth with particularity in the appended claims. The invention will be best understood from the following description when read in conjunction with the accompanying drawings.

DESCRIPTION OF THE PREFERRED EMBODIMENT

Figure 1:
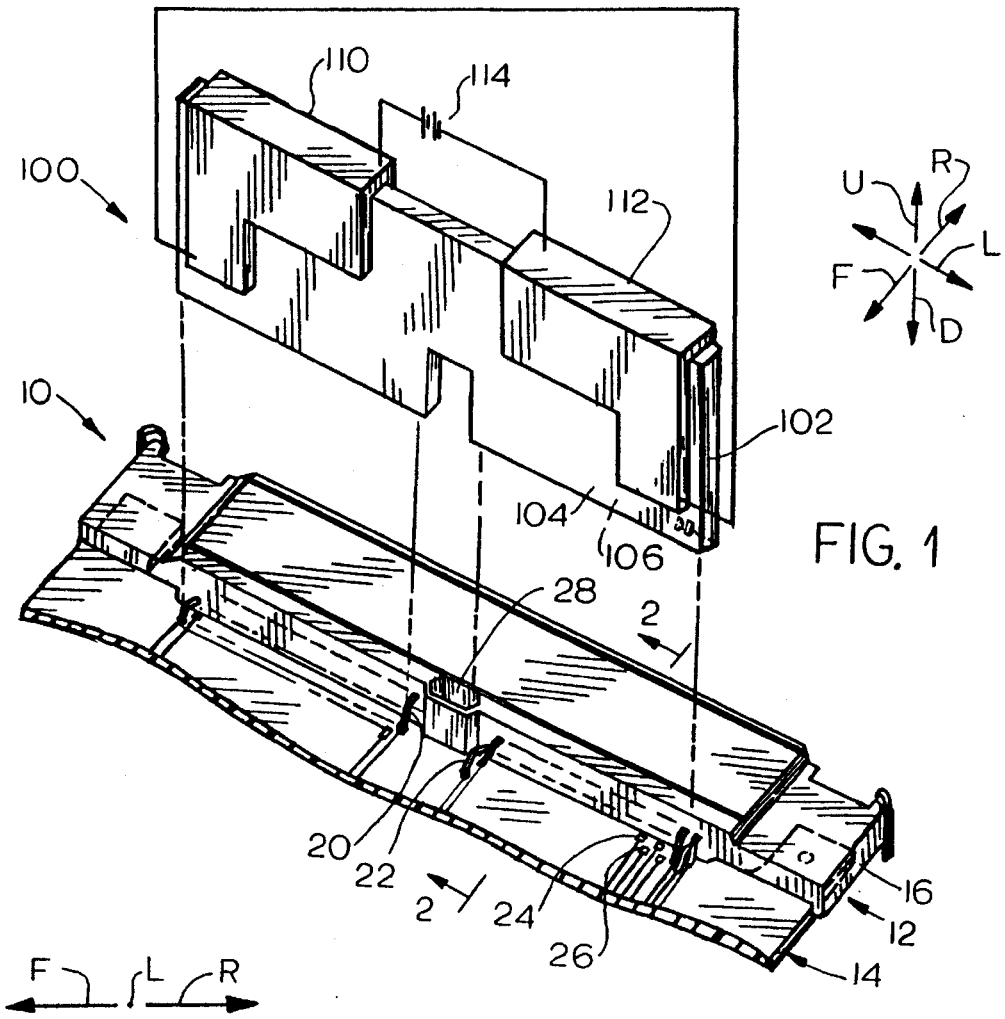
FIG. 1 is a partial isometric view of a contact arrangement of the present invention, and of a heating bar that can be used in the manufacture of the contact arrangement and which is also constructed in accordance with the present invention.

FIG. 1 illustrates a contact arrangement 10 which is part of an IC (integrated circuit) card. The arrangement includes a connector 12 at the rear of the card, which is terminated to a circuit board 14 that extends in a forward direction F along most of the length of the card. The connector includes a frame with a molded plastic dielectric housing 16 and two rows of contacts including upper and lower rows 20, 22 with tails extending forwardly from the housing. The circuit board has two rows of conductive pads, including rear and front rows 24, 26. Both the rows of contacts and the rows of conductive pads extend in a lateral direction L, which is perpendicular to a longitudinal direction indicated by front and rear arrows F, R, and which is perpendicular to the vertical direction indicated by up and down arrows U, D. The particular IC card of which the contact arrangement 10 is a part, has small dimensions, with the width of the connector in the lateral direction L being 53 millimeters. There are forty-four contacts arranged in the two rows, with each row being interrupted at a lateral center portion 28 of the connector. The termination assembly is constructed so the tails have a minimal longitudinal length.

It should be noted that while terms such as "up", "down", "horizontal" etc. are used to describe the parts as illustrated in the drawings, and to indicate the relative positions of the parts, it should be understood that the contact arrangement and its parts can be used in any orientation with respect gravity.

Figure 2:
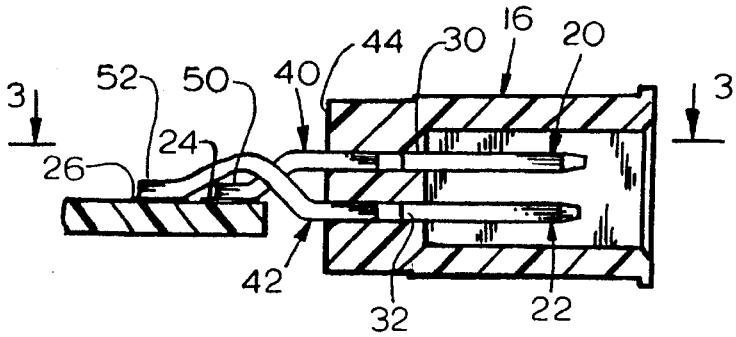
FIG. 2 is a sectional view of the contact arrangement of FIG. 1, taken on the line 2—2 thereof.
Figure 3:
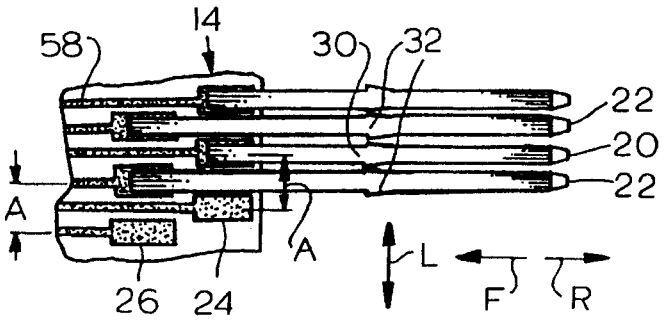
FIG. 3 is a view taken on the line 3—3 of FIG. 2, but without showing the connector housing.

As shown in FIG. 2, the upper and lower contacts 20, 22 have mount portions 30, 32 that are mounted in the dielectric housing 16. The mount portions 30, 32 of the two rows of contacts are staggered, in that each upper mount portion 30 lies laterally (in direction L) between two lower mount portions 32. The mount portions are generally molded in place within the dielectric housing. The upper and lower contacts 20, 22 respectively have upper and lower contact tails 40, 42 that generally extend in a forward direction F from a rear end part 44 of the dielectric housing. The upper contact tails 40 have front ends 50 that are terminated or joined, as by soldering, to the rear conductive pads 24, while the lower contact tails 42 have front ends 52 that are terminated to the forward conductive pads 26. As shown in FIG. 3, the forward conductive pads 24 are laterally spaced apart by a pitched distance A, as are the rear conductive pads 26. The upper contacts 20 are similarly spaced at a pitched distance A as are the lower contacts 22.

Figure 4:
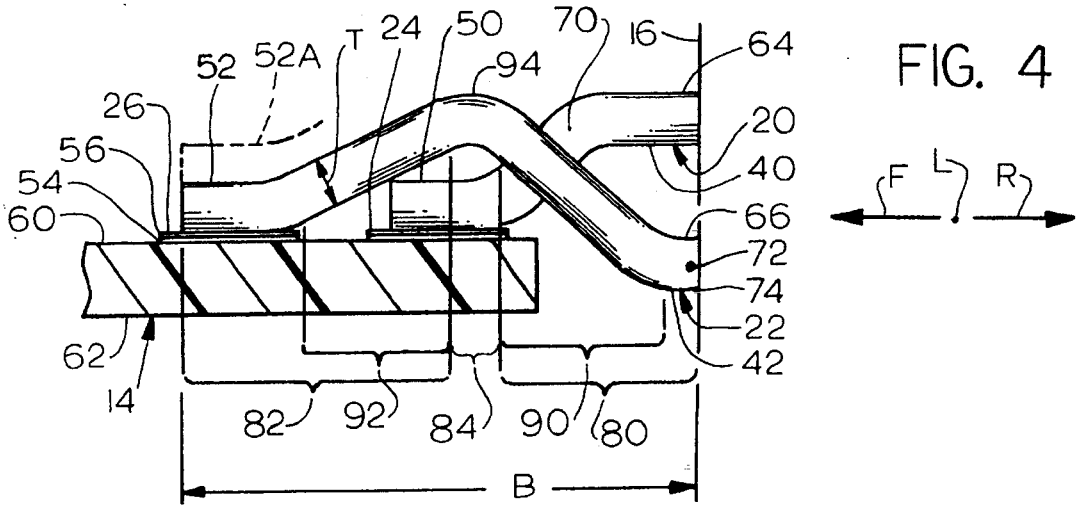
FIG. 4 is an enlarged view of a portion of the contact arrangement of FIG. 2.

As shown in FIG. 4, each of the conductive pads such as 26, includes a conductive pad region 54 of a composition such as gold-plated copper which does not melt at soldering temperatures (e.g. about 200° C.). The original pad includes a solder layer 56 of solder such as a lead-tin composition. It is noted that the pads 54 may have narrow traces 58 (FIG. 3) extending along the circuit board, which are not shown in FIG. 4. The circuit board has top and bottom faces 60, 62 and the two rows of pads lie on the top face. The front ends 50, 52 of the contact tails are joined to the conductive pads 24, 26 by pressing down the front ends while applying heat to them. The tails preferably have a relatively short longitudinal length in the directions F, R compared to their thicknesses T, to occupy a minimum of space. However, the tails must be capable of being downwardly deflected during soldering, and preferably apply only a small upward force tending to deflect them up from the solder joint. Such downward deflection of the tails is necessary because some of the tail front ends such as shown at 52A may lie higher than others, due to the difficulty of bending and mounting all miniature tails so the front ends lie at the same level. If the tails have low compliance or flexibility in vertical bending of their front ends, then there may be stresses near their rear ends 64, 66 and/or there may be a danger that their front ends may pull away from the conductive pads if the solder joints are not good.

The rear ends 64 of the upper tails 40 lie above the level of the circuit board top face 60. As a result, the upper tails 40 require an inclined part 70 which extends at a downward-forward incline to the front end 50. The inclined part 70 provides length for the upper tails so they have moderate flexibility. The rear ends 66 of the lower tails 42 lie substantially no higher than the top face 60 of the circuit board, in that the middle 72 lies below the level of the circuit board top face 60, and the bottom 74 of the rear end lies further below the circuit board top face. The lower tails require a portion that extend upwardly to above the level of the circuit board top face 60, and another portion that extends at a downward incline.

Each lower tail 42 has a rear portion 80 that generally extends at an upward-forward incline, a front portion 82 that generally extends at a downward-forward incline and that includes the front end 52, and a middle portion 84 that is a transition between the front and rear portions. The rear portion 80 includes the rear end 66 that extends substantially horizontal for a short distance forward of the dielectric housing 16 (although this is not required) and includes an inclined part 90 that extends at an upward-forward incline. The front portion 82 includes an inclined part 92 that extends at a downward-forward incline that merges with the front end 52 which extends horizontally. The middle part 84 is curved and forms a top location 94 of the lower tail. The top location 94 lies as high as the rear end 64 of an upper tail. The middle portion 84 is curved, while most of the inclined parts 90, 92 are straight, which facilitates precise bending of the tails. Because of the need for both an upward incline (so the middle of the tail lies above the circuit board) and a downward incline for the lower tail, which results in the need for an appreciable longitudinal distance of the lower tail, applicant prefers to join the front end 52 of the lower tail to the forward row of conductive pads 26. The lower tail part 90 that extends at an upward-forward incline, crosses the downward-forwardly inclined part 70 of the upper tail, as seen in FIG. 4 which is taken along the lateral direction L. The above-described lower tail 42 has large flexibility compared to its thickness, but the tails occupy only a relatively small longitudinal length B of the IC card that includes the contact arrangement.

As shown in FIG. 1, a reflow solder heating apparatus 100 is used to solder the forward ends of the contact tails to the conductive pads on the circuit board. The apparatus includes a heating bar 102 with a lower portion 104 having a lower surface 106 that contacts the forward ends of the contact tails. A pair of resistance heating elements 110, 112 are mounted on the heating bar and are connected in series through a current source 114 to create heat that heats the bar 102. When the bar is heated, a press (not shown) lowers the apparatus 100 to press it down against the contact tail ends, while the contact arrangement 10 is held in a fixture (not shown).

Figure 5:
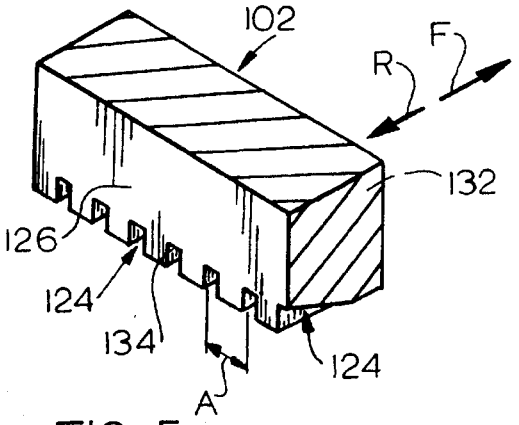
FIG. 5 is a partial sectional isometric view of the heating bar of the reflow solder heating apparatus of FIG. 1, with FIG. 5 showing the rear of the bar.
Figure 6:
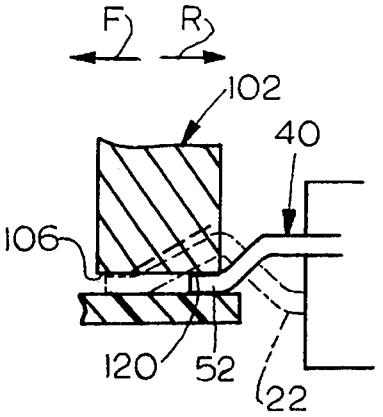
FIG. 6 is a sectional side view of the contact arrangement of FIG. 4, showing how the heating bar of FIG. 5 is used to terminate forward ends of the upper contact tails.
Figure 8:
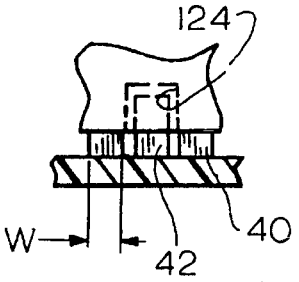
FIG. 8 is a partial front elevation view of the contact arrangement and heating bar of FIG. 6.
Figure 7:
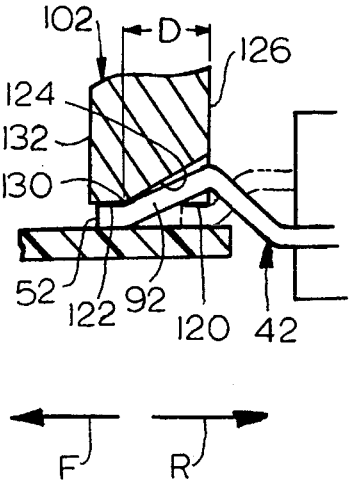
FIG. 7 is a view similar to FIG. 6, but showing how the heating bar is used to terminate ends of the lower contact tails.

FIGS. 6 and 7 show rearward and forward portions 120, 122 of a heating bar lower surface 106 pressing against the tail front ends. FIG. 6 shows a cross section of the heating bar that presses against the front end 52 of an upper tail 40. FIG. 7 shows another cross section of the heating bar 102, which includes a slot 124 that receives the inclined part 94 of the lower contact front portion. The slot 124 is tall enough and wide enough to avoid firm engagement, and preferably any engagement, with any part of the lower tail that lies rearward of its horizontally-extending front end 52. Any such engagement could flatten" the lower tail during soldering, resulting in a tendency to spring back to its original orientation, as well as avoiding excess heating of the tail. As shown in FIG. 8, the slot 124 is wider than the tail 42. As shown in FIG. 7, the slot 124 extends a distance D forward of the rearward end 126 of the bar, with the front end 130 of the slot spaced forwardly of the front end 132 of the heating bar. The slot preferably extends at an angle from the horizontal which is slightly greater than the angle of incline of the lower tail part 92. The simple slot 124 shown is relatively easy to cut into the heating bar. FIG. 5 shows the heating bar, with the rear face 126 being shown, because that is where the rear ends 134 of the slot can be seen.

In a contact arrangement of the construction illustrated, which was used at the rear of an IC (integrated circuit) card, the distance B (FIG. 4) by which the lower tail extended forward of the housing part 16 was 4.9 mm (one-eighth inch). Each of the contact tails had a thickness T of 0.46 mm (0.018 inch) and a width W (FIG. 8) of 0.51 mm (0.020 inch). The lower contact rear inclined part 90 extended at an angle of 42° from the horizontal, while the forward inclined part 92 extended at an angle of 25° to the horizontal (the top surface 60 of the circuit board). The radius of curvature and length of the different portions and parts of the contacts are as shown in FIG. 4 relative to the thickness dimension T of 0.46 min.

Thus, the invention provides a termination arrangement wherein upper and lower rows of tails are terminated to rearward and forward rows of conductive pads on a circuit board, which provides relatively high contact tail compliance in a relatively short forward-rearward length. The lower tails, whose rear ends lie at about the same level or below the level of the circuit board top face, are bent so their rear portions have upwardly-forwardly inclined parts and the front portions have downwardly-forwardly inclined parts, with the front ends extending substantially horizontally. The front ends of the lower contacts are joined to the forward row of conductive pads while the front ends of the upper tails are joined to the rearward row of pads. The configuration of the lower tails and their joining to the forward pads, results in considerable compliance for the contacts while they extend only a relatively short distance rearward of the dielectric housing part that they extend from. The front ends of the tails can be reflow soldered to the conductive pads of the circuit board by a heating bar that has slots. The slots extend from the rear end of the bar to locations spaced rearwardly of the front end of the bar. The height and width of the slots are chosen to receive the downwardly-forwardly inclined parts of the front portion of the lower tail and usually also part of the middle portion of the lower tail.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A termination arrangement comprising a circuit board having a top face lying in a substantially horizontal plane and having laterally extending front and rear rows of conductive pads on said top face, and a connector which includes a dielectric housing lying rearward of said circuit board, with said dielectric housing lying closer to said rear row of conductive pads than to said front row of conductive pads, said connector including upper and lower laterally extending rows of contacts mounted in said housing, said rows of contacts comprising upper contacts having upper contact tails and lower contacts having lower contact tails, with each of said contact tails having a forward end joined to one of said conductive pads, said tails having rear ends, with the rear ends of said upper tails lying above the level of said circuit board top face and above the rear ends of said lower tails, with said upper tails extending generally at a downward-forward incline from their rear ends to their front ends, wherein said lower tails are longer than said upper tails but said lower tails have a short forward-to-rearward length and yet the forward ends of said lower tails can be resiliently deflectable to be readily joined to said conductive pads, characterized by:

said lower tails each have a rear portion that extends at an upward-forward incline, a forward portion that extends at a downward-forward incline, and a middle lying between said portions, with said rear portion extending at an upward-forward incline of an average of about 42° to said horizontal plane.

2. The arrangement described in claim 1 wherein:

said lower tails have longer lengths in forward directions than said upper tails, and said front ends of said upper tails are soldered to said rear row of contact pads while said front ends of said lower tails are soldered to said front row of contact pads.

3. The arrangement described in claim 1 wherein: said part of said forward portion extends at a downward-forward incline of about 25°.

4. The arrangement described in claim 1 wherein:

said lower tails have middle portions lying between said front and rear portions, with each middle portion having a part lying as high as the highest location along said upper tails.

5. A termination arrangement comprising:

a circuit board having top and bottom faces lying in substantially horizontal planes and having laterally extending front and rear rows of conductive pads on said top face;

a connector which includes a dielectric housing lying rearward of said circuit board, said dielectric housing lying closer to rear row of conductive pads than to said front row of conductive pads, said connector also including upper and lower laterally extending rows of contacts mounted in said housing, said rows of contacts comprising upper and lower contacts respectively including upper and lower contact tails, said tails having front ends joined to said conductive pads, with rear ends of said upper tails lying above the level of said circuit board top face and above the rear ends of said lower tails;

said lower tails are longer than said upper tails, and the front ends of said upper tails are joined to said conductive pads of said rear row of pads while said front ends of said lower tails are joined to said conductive pads of said from row of pads;

each of said lower tails has a rear portion with a part that extends at an upward-forward incline and a front portion with a part that extends at a downward-forward incline.

6. A method for attaching the front ends of the tails of contact to conductive pads, where the pads lie in staggered front and rear laterally-extending rows on a top face of a circuit board, and the contact tails comprise upper and lower tails that have rear ends lying respectively in upper and lower rows at the rear of a connector housing, and the connector housing lies rearward of said rows of conductive pads, with said connector housing lying closer to said rear row than to said front row characterized by:

bending said upper tails so they generally extend at a downward-forward incline between said rear and front ends thereof;

bending said lower tails so said front ends of said lower tails lie forward of the front ends of said upper tails;

positioning said tails so said front ends of upper tails lie on said pads of said rear row and the front ends of said lower tails lie on said pads of said front row, and soldering said tail front ends to said pads;

said step of bending said lower tails includes bending them so rearward portions of said lower tails extend at an upward-forward incline from said rear ends thereof, and forward portions of said lower tails extend at an upward-rearward incline from said front ends thereof.

7. The method described in claim 6 wherein said step of soldering includes:

constructing a heating bar with front and rear ends and with a lower portion having a lower face that can rest on said contact front ends, including forming slots in said lower portion that each extends up from said lower face, from a location spaced rearward of the front end of the bar and to the rear end of the bar, with each slot being wider than said front portions of said lower tails; and heating said heating bar and pressing said lower face against said front ends of said tails, including receiving said forward portions of said lower tails in said slots.

* * * * *